US006826893B2

(12) United States Patent
Cere'

(10) Patent No.: US 6,826,893 B2
(45) Date of Patent: Dec. 7, 2004

(54) APPARATUS FOR WRAPPING PRODUCTS WITH PLASTIC FILM

(75) Inventor: Mauro Cere' , Loiano (IT)

(73) Assignee: Aetna Group, S.p.A., Rimini (IT)

( * ) Notice: Subject to any disclaimer, the term of this patent is extended or adjusted under 35 U.S.C. 154(b) by 0 days.

(21) Appl. No.: 10/311,024

(22) PCT Filed: Apr. 24, 2002

(86) PCT No.: PCT/IB02/01396

§ 371 (c)(1),
(2), (4) Date: Dec. 11, 2002

(87) PCT Pub. No.: WO02/087971

PCT Pub. Date: Nov. 7, 2002

(65) Prior Publication Data

US 2003/0145563 A1 Aug. 7, 2003

(30) Foreign Application Priority Data

Apr. 27, 2001 (IT) ..... BO2001A0259

(51) Int. Cl.[7] ..... B65B 53/00
(52) U.S. Cl. ..... 53/556; 53/588
(58) Field of Search ..... 53/556, 588, 210, 53/64

(56) References Cited

U.S. PATENT DOCUMENTS 4,862,678 A * 9/1989 Humphrey ..... 53/556
4,866,909 A * 9/1989 Lancaster, III et al. ..... 53/556
5,027,579 A * 7/1991 Keip ..... 53/588
5,311,725 A * 5/1994 Martin et al. ..... 53/556
5,491,956 A * 2/1996 Donnelly et al. ..... 53/556
5,575,138 A * 11/1996 Reigrut et al. ..... 53/556
5,768,862 A * 6/1998 Mauro ..... 53/556
5,836,140 A * 11/1998 Lancaster, III ..... 53/556
5,875,616 A * 3/1999 Paavola et al. ..... 53/556
6,745,544 B2 * 6/2004 Matsumoto et al. ..... 53/399

FOREIGN PATENT DOCUMENTS

DE 4234604 A1 * 4/1994 ..... B65B/11/04
EP 0 811 554 A1 12/1997
GB 2107668 A * 5/1983 ..... B65B/11/04

OTHER PUBLICATIONS

International Search Report pertaining to corresponding International Application No. PCT/IB02/01396.

* cited by examiner

*Primary Examiner*—Stephen F. Gerrity
(74) *Attorney, Agent, or Firm*—Fay, Sharpe, Fagan, Minnich & McKee, LLP

(57) ABSTRACT

An apparatus for wrapping products with plastic film includes: a ring-shaped element supporting a carriage; a drive mechanism for moving the ring-shaped element relative to the group of products; and, a motor for driving the carriage. The carriage mounts a roll of film and a pre-stretching unit that includes a pair of rollers and a transmission and control roller that swings towards and away from the products and is designed to start or stop film feed according to its position relative to the products. The drive mechanism for the pre-stretching unit includes a kinematic chain including the motor and a drive take-off track. An engage/release unit is connected to and controlled by the transmission roller and designed to transmit drive from the take-off track to the pre-stretching rollers according to the position of the transmission roller.

11 Claims, 3 Drawing Sheets

APPARATUS FOR WRAPPING PRODUCTS WITH PLASTIC FILM

This application is a National Stage filing under 35 U.S.C. § 371 of International Application No. PCT/IB02/01396, which has an international filing date of Apr. 24, 2002, and which designated the United States of America.

TECHNICAL FIELD

The present invention relates to apparatus for wrapping products with plastic film.

BACKGROUND ART

Prior art apparatus used for this purpose comes in numerous different kinds and designs and, in a first solution for palletised products, which will be described here purely by way of example, may consist of a supporting frame, usually in the form of a gantry structure, and a roll mounting carriage supported by a structure which is in turn supported by the supporting frame. The supporting frame is normally located near a roller or belt conveyor or a similar transporting system which feeds the products to be wrapped. The incoming products are usually already positioned on a pallet suitable for subsequent handling and transportation.

The roll mounting carriage supports a roll of plastic stretch film and, usually, a unit for unwinding and pre-stretching the film wound on the roll. The pre-stretching unit consists of one or more rotating power rollers driven by an electric motor (through suitable transmission means) mounted on the carriage itself. The film is unwound from the roll and wound onto the power rollers of the pre-stretching unit before being placed over the products to be wrapped.

The supporting structures are of two basic types: one with an arm in the shape of an upturned L and the other orbital, shaped like a ring. The supporting structure, of whichever type, is designed to move the carriage along a closed path (either circular or helical) about a vertical axis substantially coinciding with the vertical axis of the products to be wrapped, positioned on the pallet. Thus, the roll is made to rotate around the products and, depending on requirements and the size of the products concerned, may also be made to rise and fall along the vertical axis of the products so as to completely wrap the products from top to bottom with two or more windings of film. Usually, during the wrapping process, the film is stretched, that is to say, "pulled" lengthways, by the pre-stretching unit. The purpose of stretching the film before placing it on the products is twofold: to save on the amount of film used and to suitably tension it so as to improve its adhesion to the products, especially if the products are in tall stacks.

The present disclosure relates in particular to an orbital type supporting structure. In a supporting structure of this type, a ring mounted on the supporting frame is raised off the floor and moved up and down along the frame. At the same time, the roll mounting carriage, which is supported by the ring, is guided around the products by the ring. The ring is raised and moved up and down by drive motors, while the roil mounting carriage is driven along the wrapping path around the ring by an electric motor mounted on the roll mounting carriage itself.

Both the electric motor that drives and rotates the carriage and the electric motor that drives the pre-stretching unit are powered through sliding contact connections positioned and operating on the supporting guide ring.

The supporting ring structure, however, has several disadvantages which limit its field of application and which are due, in particular, to the sliding contact connections. Connections of this type prevent the construction of high efficiency protections, which means that the apparatus can only be installed in environments with a high humidity.

Further, sliding contacts are subject to heavy wear and do not permit high operating speeds to be reached, and this significantly limits the productivity of the apparatus.

To overcome these disadvantages, the Applicant devised an apparatus, disclosed in European patent EP-811.554, including a structure to support the roll mounting carriage and a pre-stretching unit driven by a respective electric motor. The supporting structure comprises a raised mobile structure mounted on the supporting frame and a rotatable ring mounted on the raised mobile structure and rotated about its axis by a motor anchored and kinematically connected to the raised mobile structure. The carriage is attached to the rotatable ring and mounts an electric generator designed to power the electric motor of the pre-stretching unit whose shaft is maintained in permanent kinematic connection with an annular toothed track attached to the raised mobile structure.

This solution solved many of the problems caused by the power supply of the previous solution, although the presence of a second ring and the higher number of power supplies and electrical connections had the effect of increasing the cost of constructing the apparatus.

The description and drawbacks outlined above also apply, but with some of the technical details differing, to apparatus where the ring structure extends in a vertical plane and the products move in a horizontal direction through the ring and are wrapped in successive windings of film along a horizontal wrapping axis.

DISCLOSURE OF THE INVENTION

The present invention has for an object to provide, as a valid alternative to the structural solution described above, a product wrapping apparatus whose wrapping structure has been greatly simplified, with highly reliable sturdy components, while maintaining the same high speed and wrapping quality features.

Another object of the invention is to provide a wrapping apparatus that can be easily adapted to wrap products either along a vertical axis or along a horizontal axis.

Accordingly, the present invention provides an apparatus for wrapping products with plastic film and comprising: a ring-shaped element supporting a carriage that moves around the ring-shaped element; drive means for moving the ring-shaped element relative to the group of products to be wrapped; main motor means associated to the ring-shaped element and designed to drive the carriage. The carriage mounts a roll of plastic film and a pre-stretching unit driven by suitable drive means. The pre-stretching unit comprises a pair of rollers for pre-stretching the film and a transmission and control roller that swings towards and away from the group of products, and is designed to start or stop film feed according to its position relative to the products to be wrapped. The drive means comprise a kinematic chain consisting of the main motor means and a ring-shaped, continuous drive take-off track for the pre-stretching unit drive means which comprise an engage/release unit connected to and controlled by the transmission roller and designed to transmit drive from the ring-shaped track to the pair of pre-stretching rollers according to the position of the transmission roller.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
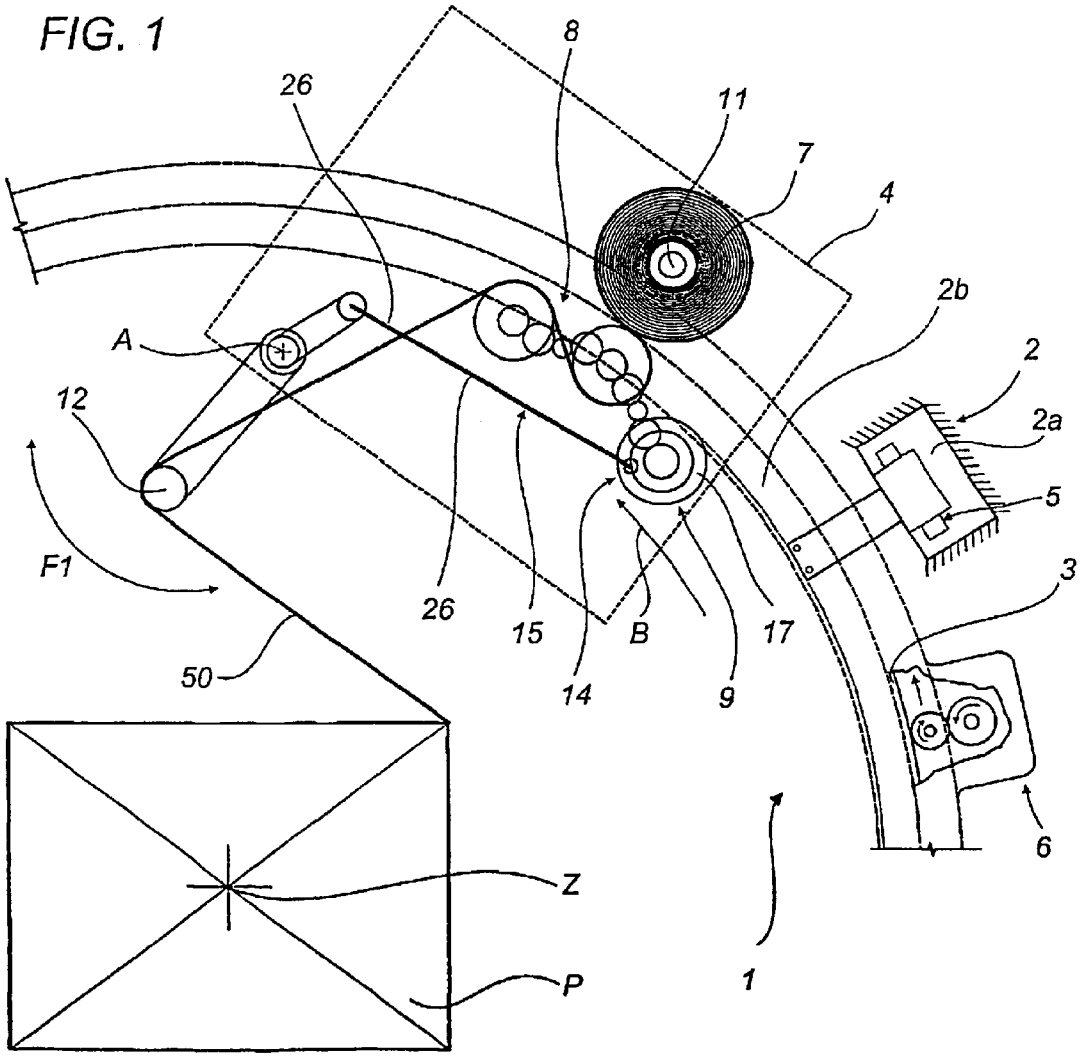
FIG. 1 is a schematic top plan view, with some parts cut away in order to better illustrate others, of a part of an apparatus for wrapping groups of products with plastic film according to the present invention.

With reference to the accompanying drawings, in particular FIG. 1, the apparatus according to the present invention, denoted in its entirety by the numeral 1, is used to wrap groups P of products with a plastic film 50.

In particular, the apparatus described herein is of the type that wraps groups of products about a vertical axis by moving the wrapping unit in a vertical direction, but the solution according to the invention can be adapted without changes or restrictions to known apparatus that wraps groups of products about a horizontal axis by moving the groups of products in a horizontal direction.

The apparatus 1 essentially comprises:

a frame 2 that mounts a ring-shaped element 3 supporting a carriage 4 that moves around the ring-shaped element 3;

drive means 5 for moving the ring-shaped element 3 relative to the group P of products to be wrapped along a wrapping axis;

main motor means 6 associated to the ring-shaped element 3 and designed to drive the carriage 4 around the group P of products.

In particular, see FIG. 1 again, the supporting structure of the carriage 4 illustrated, purely as a non-restricting example, is substantially the same as that described in patent EP-811.554 in the name of the same Applicant as the present. In practice, the frame 2 comprises a set of uprights 2*a* associated to a mobile ring 2*b* that is driven along a vertical axis Z by the aforementioned means 5 consisting, for example, of chains (not illustrated) inside the uprights 2*a*.

The ring 2*b* supports the aforementioned main motor means 6 which are kinematically connected to the ring-shaped element 3 positioned inside the ring 2*b* in such a way as to enable the carriage 4 to rotate about the wrapping axis Z (see arrow B).

The carriage 4 mounts a roll 7 of plastic film 50 and a pre-stretching unit 8 driven by suitable drive means 9.

Figure 2:
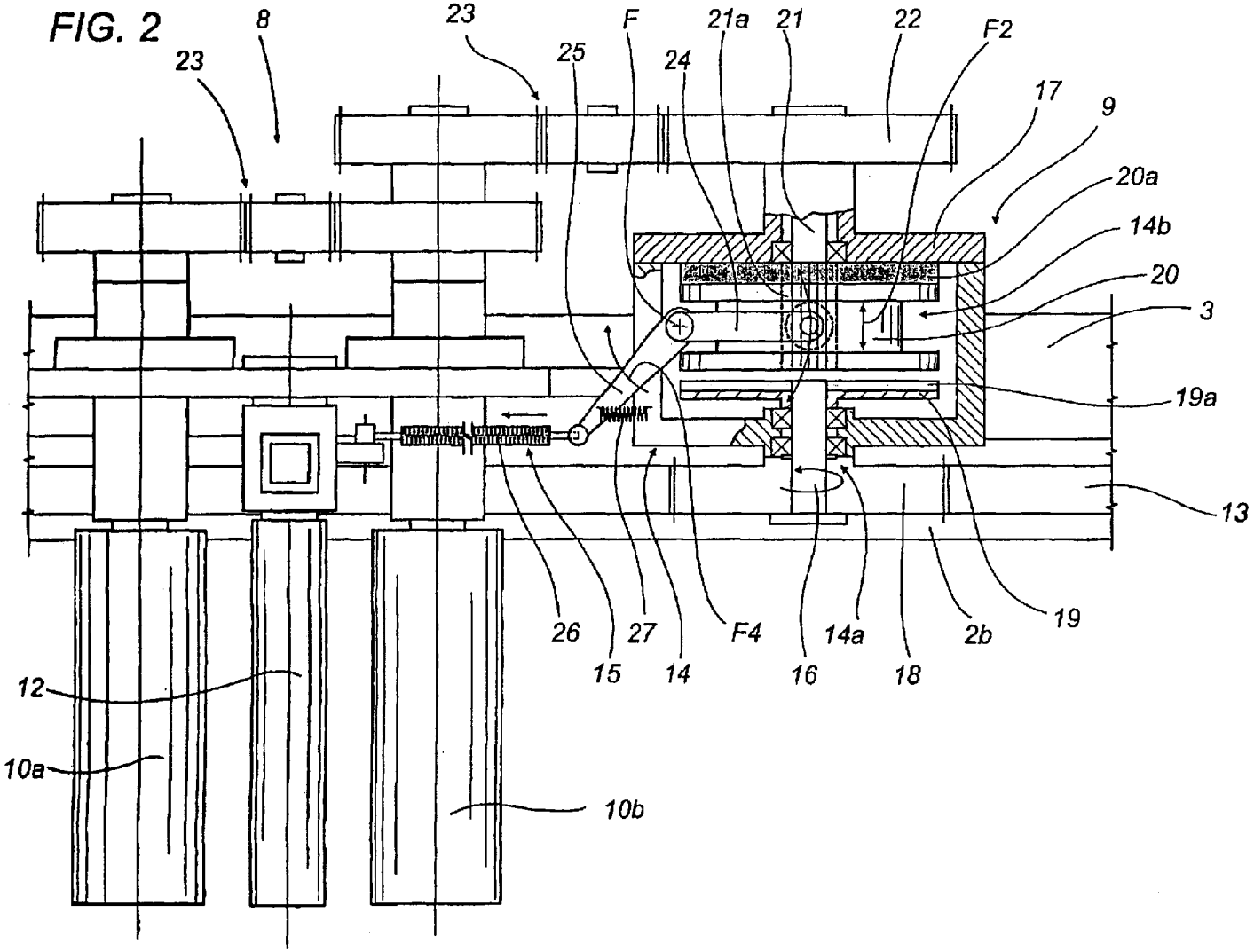
FIG. 2 is a schematic front view, with some parts cut away in order to better illustrate others, of a part of the apparatus of FIG. 1, namely a roll mounting carriage.

As shown in FIGS. 1 and 2, the pre-stretching unit 8 comprises a pair of film 50 pre-stretching rollers 10*a* and 10*b* (that is to say, a slow roller and a fast roller) located close to a roll 7 mounting shaft 11, and at least one transmission and control roller 12 pivoted on the carriage 4 at A in such a way as to swing towards and away from the group P of products (see arrow F1 in FIG. 1): this swinging motion permits starting and stopping of film 50 feed through the drive means 9 according to the position of the roller 12 relative to the group P of products. In other terms, when the transmission roller 12 swings towards the group P of products, the film 50 starts unwinding, and when the roller 12 swings away from the group P of products, the film 50 slows down and/or stops.

Looking more closely at the technical details, the drive means 9 that move the pre-stretching unit 8 comprise a kinematic chain consisting at least of the main motor means 6, which rotate the carriage 4, and a ring-shaped, continuous drive take-off track 13 for the drive means 9 of the pre-stretching unit 8.

The drive means 9 comprise an engage/release unit 14 connected to and controlled by the transmission roller 12 and designed to transfer drive from the ring-shaped track 13 to the pair of pre-stretching rollers 10*a* and 10*b* according to the position of the transmission roller 12 relative to the group P of products.

Figure 3:
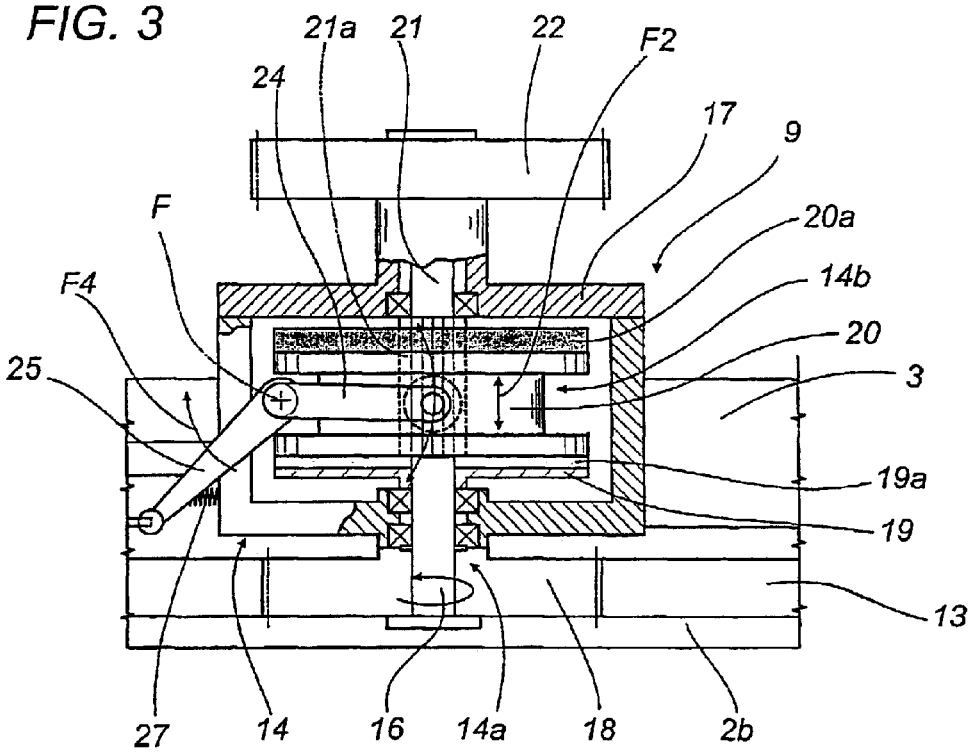
FIG. 3 is a schematic front view, with some parts in cross section and some cut away in order to better illustrate others, of a detail from FIG. 2 showing a brake and clutch assembly in the working position.

More specifically, see FIGS. 2 and 3, the engage/release unit is a clutch and brake assembly 14 comprising a fixed first portion 14*a* kinematically connected to the ring-shaped drive take-off track 13 and a mobile second portion 14*b* that is kinematically connected to the pre-stretching unit 8.

The second portion 14*b* is associated to means 15 of connection to the transmission and control roller 12 designed to enable the second portion 14*b* to be moved at least between two limit positions, of which the first is an idle position where the second portion 14*b* is away from the first portion 14*a* and stops the rotation of the pre-stretching rollers 10*a* and 10*b* (see FIG. 2), and the second is a working position where the second portion 14*b* is in contact with the first portion 14*a* enabling drive to be transmitted from the ring-shaped track 13 to the pair of pre-stretching rollers 10*a* and 10*b* (see FIG. 3).

Looking in more detail, the fixed first portion 14*a* comprises a rotatable idle shaft 16 supported by a cylindrical container 17.

At a first outside end of it under the container element 17, the first shaft 16 mounts a first toothed wheel 18 for continuous kinematic connection with the ring-shaped track 13, and at the other end of it, inside the container element 17, the first shaft 16 is rigidly connected to a first contact disc 19 for transmitting drive to the mobile second portion 14*b*.

Inside the container element 17, the mobile second portion 14*b* comprises a second disc 20 facing the first disc 19 and keyed to a second shaft 21 which is coaxial with the first shaft 16 and protrudes from the container element 17.

At its outermost end, the second shaft 21 mounts a second toothed wheel 22 which is kinematically connected through a gear train 23 to the aforementioned pre-stretching rollers 10*a* and 10*b*.

Figure 4:
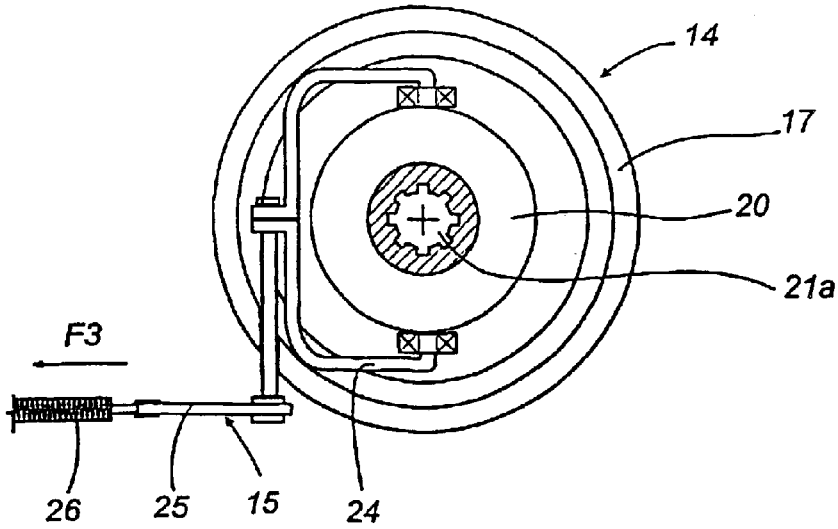
FIG. 4 is a schematic top plan view, with some parts cut away in order to better illustrate others, of the brake and clutch assembly of FIG. 3.

As shown also in FIG. 4, the second disc 20 is keyed to the second shaft 21 through a splined portion 21*a* of the second shaft 21, in such a way as to allow the second disc 20 to slide from the aforementioned idle position to the working position, and vice versa (see arrow F2 in FIGS. 2 and 3).

The aforementioned connection means 15 between the transmission roller 12 and the second disc 20 comprise a fork 24 linked bilaterally to the second disc 20 and pivoted at F at the container element 17.

The fork 24 is connected, at the pivot point F, to a mobile control lever 25 which is in turn linked to first elastic drive means 26 controlled by the transmission roller 12: this connection allows the second disc 20 to slide from the aforementioned idle position to the working position, and vice versa, according to the position of the transmission roller 12.

In other terms, the movement of the transmission roller 12 towards the group P of products displaces the first elastic means 26 in a horizontal plane, see arrow F3, (these means may consist of a link rod with a control spring inside it). This movement of the first elastic means 26 lifts the lever 25 (see arrow F4), thus moving the second disc 20 towards and into contact with the first disc 19 in such a way as to enable transmission of drive between the ring-shaped track 13 and the pre-stretching rollers 10*a* and 10*b*.

To achieve a rapid and sure grip between the two discs 19 and 20, the first disc 19 has a surface 19*a* with a high friction coefficient so that, on contact with the second disc 20, drive is quickly and effectively transmitted between the two discs 19 and 20.

Similarly, the second disc 20 also has a surface 20*a* with a high friction coefficient, facing the container element 17, so that the second disc 20 itself, and hence the pre-stretching unit 8, is stopped rapidly on reaching the aforementioned idle position.

The numeral 27 denotes second elastic means that may be fitted to the control lever 25, these second means 27 being interposable between the control lever 25 and the container element 17 in such a way as to allow the control lever 25 to be automatically moved to a position corresponding to the idle position of the second disc 20 as rapidly as possible when the transmission roller 12 moves away from the group P of products.

In practice, therefore, the apparatus structured as described above achieves the aforementioned aims thanks to a simplified kinematic chain which, however, allows the feeding of the film 50 to be controlled accurately, rapidly and extremely functionally according to the position of the transmission roller 12. This kinematic chain also allows the cost of the apparatus to be greatly reduced while maintaining reliability at a high level.

This structural solution for the apparatus, that is to say, with ring structure and wrapping carriage, can also be applied, without departing from the scope of the basic inventive concept, to apparatus extending in a vertical plane where the groups of products are fed in a horizontal direction in such a way that they move into the ring structure.

It will be understood that the invention can be subject to modifications and variations without thereby departing from the scope of the inventive concept. Moreover, all the details of the invention may be substituted by technically equivalent elements.

What is claimed is:

1. An apparatus (1) for wrapping a group of products with plastic film (50), the apparatus comprising:

a frame (2) that mounts a ring-shaped element (3) supporting a carriage (4) that moves around the ring-shaped element (3);

drive means (5) for moving the ring-shaped element (3) relative to the group (P) of products to be wrapped along a wrapping axis;

main motor means (6) for driving the carriage (4) around the group (P) of products;

the carriage (4) adapted to mount a roll (7) of plastic film (50) and further comprising a pre-stretching unit (8) driven by drive means (9) for the pre-stretching unit;

the pre-stretching unit (8) comprising a pair of film pre-stretching rollers (10), and at least one transmission and control roller (12) that swings towards and away from an associated group (P) of products to be wrapped, said transmission and control roller adapted to start or stop film feed, through the pre-stretching unit drive means (9), according to its position relative to the associated group (P) of products to be wrapped, wherein the pre-stretching unit drive means (9) comprise a kinematic chain comprising: the main motor means (6) for rotating the carriage (4); a ring-shaped, continuous drive take-off track (13) for the pre-stretching unit drive means (9) which comprise an engage/release unit (14) connected to and controlled by the transmission roller (12) and designed to transmit drive from the ring-shaped track (13) to the pair of pre-stretching rollers (10) according to the position of the transmission roller (12) relative to the associated group (P) of products to be wrapped.

2. The apparatus according to claim 1, wherein the engage/release unit is a clutch and brake assembly (14).

3. The apparatus according to claim 1, wherein the engage/release unit is a clutch and brake assembly (14) comprising a fixed first portion (14*a*) kinematically connected to the ring-shaped drive take-off track (13) and a mobile second portion (14*b*) that is kinematically connected to the pre-stretching unit (8) and operatively connected to means (15) of connection to the transmission and control roller (12) designed to enable the second portion (14*b*) to be moved at least between two limit positions, of which the first is an idle position where the second portion (14*b*) is away from the first portion (14*a*) and stops the rotation of the pre-stretching rollers (10), and the second is a working position where the second portion (14*b*) is in contact with the first portion (14*a*) enabling drive to be transmitted from the ring-shaped track (13) to the pair of pre-stretching rollers (10).

4. The apparatus according to claim 3, wherein the fixed first portion (14*a*) comprises a rotatable idle shaft (16) supported by a cylindrical container element (17); the first shaft (16) mounting, at a first outside end of it under the container element (17), a first toothed wheel (18) for continuous kinematic connection with the ring-shaped track (13), and the first shaft (16) being, at the other end of it, inside the container element (17), rigidly connected to a first contact disc (19) for transmitting drive to the mobile second portion (14*b*).

5. The apparatus according to claim 4 wherein the mobile second portion (14*b*) comprises, inside the container element (17), a second disc (20) facing the first disc (19) and keyed to a second shaft (21) which is coaxial with the first shaft (16) and protrudes from the container element (17); the second shaft (21) mounting, at its outermost end, a second toothed wheel (22) which is kinematically connected through a gear train (23) to the pre-stretching rollers (10).

6. The apparatus according to claim 5, wherein at least the first disc (19) has a surface (19*a*) with a high friction coefficient so that, on contact with the second disc (20), drive is transmitted between the two discs (19, 20).

7. The apparatus according to claim 5, wherein the second disc (20) is keyed to the second shaft (21) through a splined portion (21*a*) of the second shaft (21), wherein the second disc (20) is slidable from AN idle position to a working position, and from the working position to the idle position.

8. The apparatus according to claim 7, wherein at least the second disc (20) has at least one surface (20*a*) with a high friction coefficient, facing the container element (17), so that the second disc (20) itself is stopped rapidly on reaching the idle position.

9. The apparatus according to claim 7, wherein the connection means (15) further comprises a fork (24) linked bilaterally to the second disc (20) and pivoted at a pivot point (F) to a mobile control lever (25) which is in turn linked to first elastic drive means (26) controlled by the transmission roller (12) to allow the second disc (20) to slide from the idle position to the working position, and from the working position to the idle position, according to the position of the transmission roller (12).

10. The apparatus according to claim 9, wherein the control lever (25) has second elastic return means (27) interposed between the control lever (25) and the container element (17) to allow the control lever (25) to be automatically moved to a position corresponding to the idle position of the second disc (20) when the transmission roller (12) moves away from the group (P) of products.

11. An apparatus for wrapping a group of products with plastic film (50), the apparatus comprising:

a frame;

a ring-shaped element connected to the frame and movable along a wrapping axis;

a carriage movably supported on the ring-shaped element and adapted to mount an associated roll of plastic film;

a motor for driving the carriage on the ring-shaped element;

a pre-stretching unit connected to the carriage and driven by drive means for the pre-stretching unit, said pre-stretching unit comprising a pair of pre-stretching rollers and at least one transmission and control roller that moves toward and away from an associated group of products to be wrapped, said transmission and control roller adapted to start or stop film feed according to its position relative to the associated group of products to be wrapped, wherein the pre-stretching unit drive means comprise a kinematic chain comprising:

said motor for driving said carriage on said ring-shaped element;

a ring-shaped, continuous drive take-off track;

an engage/release unit connected to and continued by the transmission roller, said engage/release unit adapted to transmit drive from the ring-shaped take-off track to the pair of pre-stretching rollers based upon the position of the transmission roller.

* * * * *